US006330403B1

(12) United States Patent
Tsujita et al.

(10) Patent No.: US 6,330,403 B1
(45) Date of Patent: Dec. 11, 2001

(54) IMAGE FORMING APPARATUS WITH ADJUSTING DEVICE

(75) Inventors: Akio Tsujita; Takashi Rokutanda, both of Hitachinaka; Takao Umeda, Mito, all of (JP)

(73) Assignee: Hitachi Koki Co., Ltd., Tokyo (JP)

( * ) Notice: Subject to any disclaimer, the term of this patent is extended or adjusted under 35 U.S.C. 154(b) by 0 days.

(21) Appl. No.: 09/637,018

(22) Filed: Aug. 14, 2000

(30) Foreign Application Priority Data

Aug. 27, 1999 (JP) ..... 11-241199
Mar. 17, 2000 (JP) ..... 12-075632

(51) Int. Cl.[7] ..... G03G 15/16

(52) U.S. Cl. ..... 399/44; 399/45; 399/66; 399/317

(58) Field of Search ..... 399/66, 316, 317, 399/318, 310, 312, 313, 44, 45, 384

(56) References Cited

U.S. PATENT DOCUMENTS 4,131,358 * 12/1978 Windele ..... 399/317
4,396,273 * 8/1983 Matsuyama et al. ..... 399/316
4,796,047 * 1/1989 Fowlkes et al. ..... 399/318
4,933,723 * 6/1990 Kakuta et al. ..... 399/316

* cited by examiner

*Primary Examiner*—Joan Pendegrass
(74) *Attorney, Agent, or Firm*—Antonelli, Terry, Stout & Kraus, LLP

(57) ABSTRACT

An image forming apparatus has an image retaining body which is supported so as to be able to move endlessly, a transfer means which is installed at a specific distance away from the surface of the image retaining body or in contact with the surface of the image retaining body, and a paper guide which is installed upstream and downstream, of or at least upstream or downstream the transfer means along the moving direction of the image retaining body for guiding a sheet of paper between the image retaining body and the transfer means and for pressing the paper onto the surface of the image retaining body. The image forming apparatus is equipped with an adjusting means for adjusting the distance between the paper guide means and the transfer means along the moving direction of the image retaining body, thereby varying the length of the paper wound onto the image retaining body.

5 Claims, 3 Drawing Sheets

IMAGE FORMING APPARATUS WITH ADJUSTING DEVICE

BACKGROUND OF THE INVENTION

The present invention relates to an image forming apparatus, or so-called copying machine or printing machine, which electrophotographically produces an image on paper.

In the field of image forming, as the data volume to be processed has continued to increase, the demand for high-speed printing of high-quality, fine images is increasing year by year.

In reproducing high-quality, fine picture images by the known process of electrophotography, which involves all electrophotographic processes, including a charging process, an exposing process, a developing process, a transferring process, an erasing process, a cleaning process and a fixing process, a technique for efficiently transferring a toner image produced on an image retaining body (photosensitive body) onto a transfer material (paper is mainly used) is important.

The transfer means employed in the transferring process is briefly classified into a type using a corona discharge device and a type using a transfer roller.

Where a corona discharge device is used, the corona discharge device is installed at a specific distance away from the surface of the photosensitive body. As an electric charge of reversed polarity to that of the toner retained on the photosensitive body is supplied to the back of the paper (the surface not in contact with the surface of the photosensitive body) by the corona discharge device, the toner on the photosensitive body is transferred and adsorbed onto the paper by electrostatic attraction.

Where a transfer roller is used, the roller is positioned in contact with the photosensitive body. As a transfer bias is applied to the transfer roller, the toner retained on the photosensitive body is transferred onto the paper that is fed between the photosensitive body and transfer roller.

The corona discharge method is regarded as more effective for high-speed printing than the transfer roller method because the paper can be electrically charged at a higher speed. However, the corona discharge method is disadvantageous in that the transfer efficiency is easily affected by a change in the dielectric constant of the paper dependent upon a change in the paper thickness and/or ambient humidity and also by the thickness of the toner image to be transferred from the photosensitive body.

The transfer roller method is advantageous in that the method is applicable to printing on a variety of types of paper having different specifications because the electric charge is applied directly onto the paper that is in close contact with the toner image on the photosensitive body. However, because the transfer area is a relatively narrow nip zone formed by the contact between the photosensitive body and transfer roller, and because the paper passes through the nip area very quickly under a high-speed printing condition, a sufficient transfer time cannot be maintained. Hence, as is understood, it is difficult to apply the method to high-speed printing. Although this problem can be eliminated by installing more transfer rollers to widen the nip zone, use of more transfer rollers leads to an undesirable cost increase.

An apparatus proposed in Japanese Patent Application Laid-open Publication No. Hei 7-319331 (1995) has a composition such that the angle of the tension adjusting plate installed before and after the transfer unit is set in accordance with the ream weight of the paper to be used. However, the technique used in this Japanese Patent Application Laid Open Publication No. Hei 7-319331 (1995) is based on the need to constantly adjust the tension and length of the paper wound onto the photosensitive body by means of the above-mentioned composition, and does not suggest any technical idea for changing the length of paper wound onto the surface of the photosensitive body.

SUMMARY OF THE INVENTION

The objective of the present invention is to provide an image forming apparatus that is capable of transferring the toner image retained on an image retaining body efficiently onto paper irrespective of changes in the ambient condition, such as temperature and humidity, and the paper thickness.

The above objective is achieved by an image forming apparatus that comprises an image retaining body which is supported so as to be able to move endlessly, a transfer means which is installed at a specific distance away from the surface of the image retaining body or in contact with the surface of the image retaining body, and a paper guide which is installed upstream and downstream, or at least upstream or downstream, of the transfer means along the moving direction of the image retaining body for guiding a sheet of paper between the image retaining body and the transfer means and for pressing the paper onto the surface of the image retaining body; and the apparatus is equipped with an adjusting means for adjusting the distance between the paper guide means and the transfer means along the moving direction of the image retaining body, thereby varying the length of the paper wound onto the image retaining body.

According to the present invention, an image forming apparatus is provided that is capable of transferring the toner image retained on an image retaining body efficiently onto paper irrespective of changes in the ambient condition, such as temperature and humidity, and the ream weight of the paper.

DESCRIPTION OF THE PREFERRED EMBODIMENTS

Figure 1:
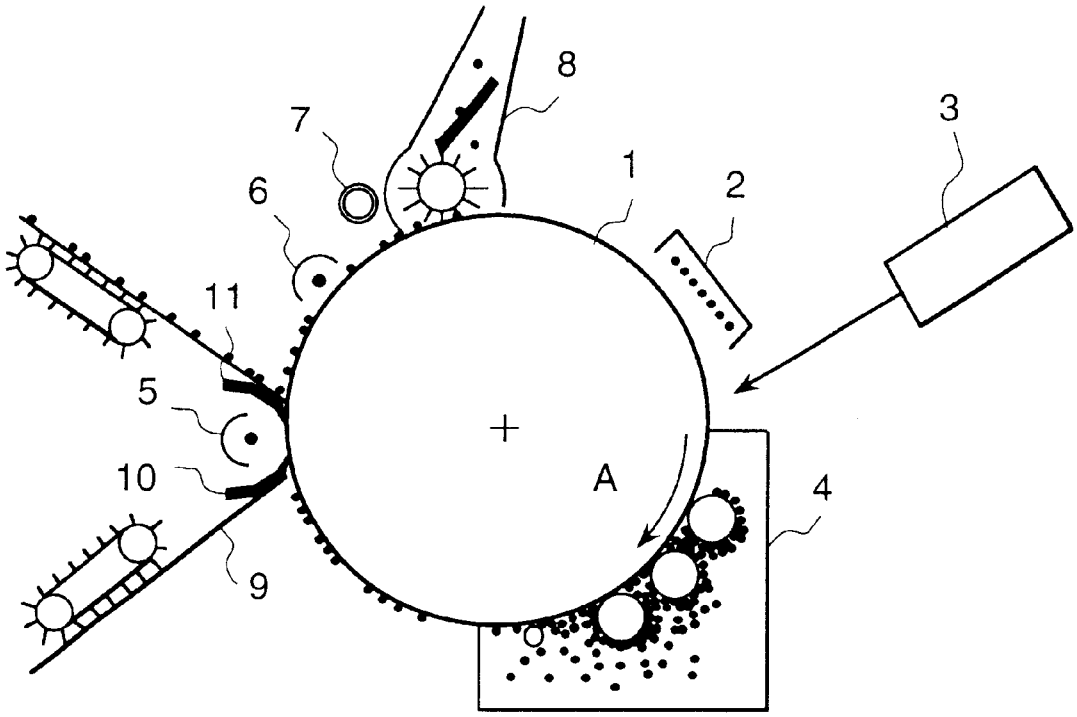
FIG. 1 is a schematic diagram showing an embodiment of the image forming apparatus according to the present invention.

Embodiments of the present invention will be explained hereunder with reference to the drawing.

(Embodiment 1)

FIG. 1 is a schematic diagram showing an embodiment of the image forming apparatus according to the present invention. In the figure, the apparatus has a photosensitive drum 1 serving as an image retaining body, and the processing devices necessary for picture image production are disposed around the photosensitive drum 1, including a charging unit 2, an exposing unit 3, a developing unit 4, a transfer unit 5, an AC discharging unit 6, an erasing lamp 7 and a cleaning unit 8. The surface of the photosensitive drum 1 is uniformly electrically charged to a specific potential by the charging unit 2 as the drum rotates along the direction of arrow A. The charged photosensitive drum 1 is exposed by the exposing unit 3 so that a latent image is produced on the photosensitive drum. In this embodiment, the exposing unit employs an Argon laser beam with a wavelength of 488 nm and produces an image pattern with a resolution of 600 dpi. The latent image produced on the photosensitive drum 1 is developed and visualized into a toner image by the developing unit 4, and the toner image is then transferred onto a sheet of paper 9 by the transfer unit 5.

The paper 9 is fed and guided between the photosensitive drum 1 and transfer unit 5 with the aid of a guide 10, as the toner image on the photosensitive drum 1 is transferred onto the paper 9. After this process, the paper 9, which carries an unfixed toner image, is guided by another guide 11, which comprises the paper guiding means, and then passes through the fixing unit (not shown) so that the unfixed toner image is fixed on the paper 9.

Then, as the photosensitive drum 1 continues to rotate, unprocessed toner that is not transferred from the photosensitive drum 1 onto the paper 9, but remains on the surface of the photosensitive body 1, is eliminated of its electrical charge by the AC discharging unit 6, and then the remaining toner is removed from the surface of the photosensitive drum 1 by the cleaning unit 8. Further, the surface of the photosensitive drum 1 is exposed to the erasing lamp 7 so that the surface electric charge is eliminated and the drum gets ready for the next charging process to produce another picture image.

Figure 2:
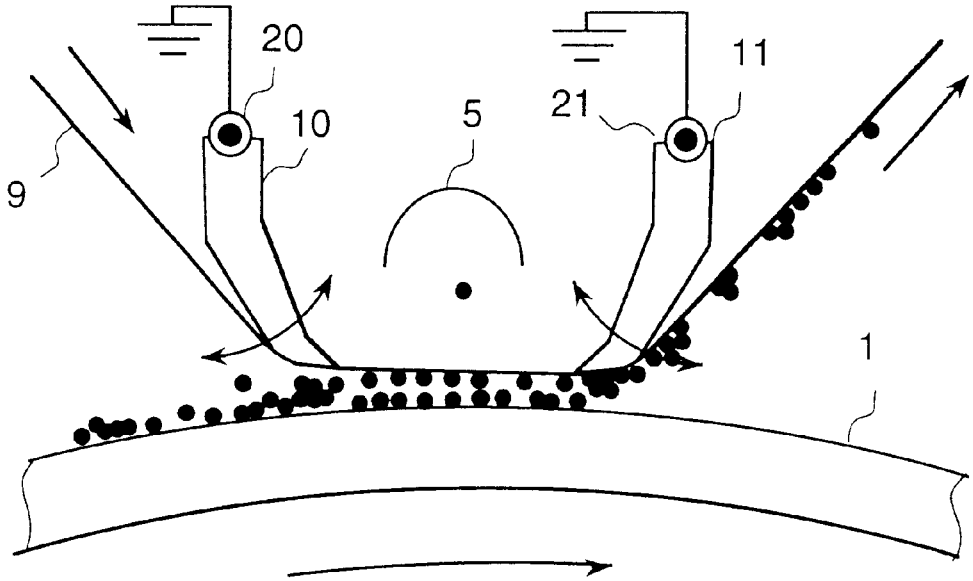
FIG. 2 is an enlarged cross-sectional view of the transferring section used in an embodiment of the present invention.
Figure 3:
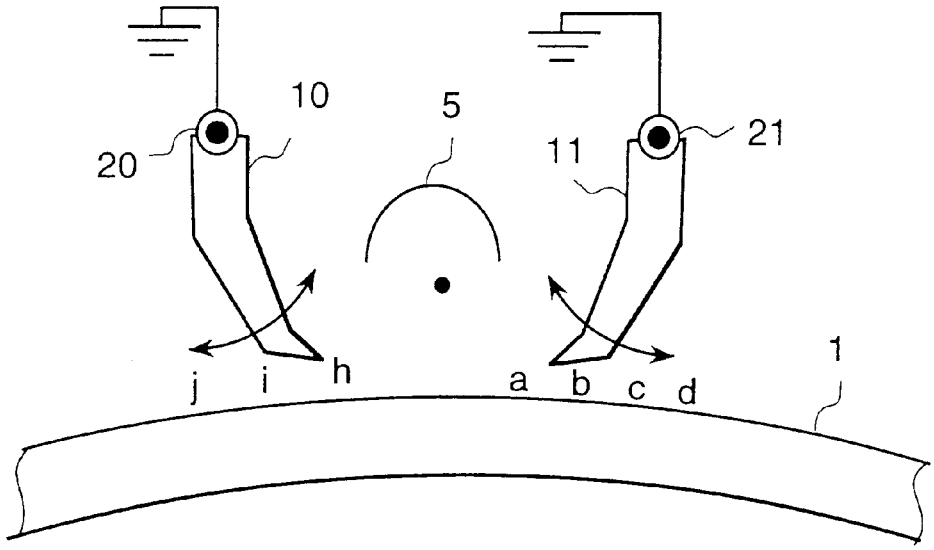
FIG. 3 is an enlarged cross-sectional view of the transferring section used in an embodiment of the present invention.

Next, the detailed composition of the transferring section will be explained with reference to FIG. 2 and FIG. 3. In this embodiment, the transfer unit 5 employs a corona discharge device, and the guide 10 and guide 11 are made of stainless steel plate and each is grounded. As shown in FIG. 3, one end of each guide 10 and 11 is connected, respectively, to the drive shafts 20 and 21, which are coupled with a drive unit, and this arrangement makes it possible for the end of the guide 10 to positioned at a point "h", "i" or "j" around the supporting point at the drive shaft 20, and for the end of the guide 11 to be positioned at a point "a", "b", "c" or "d" around the supporting point at the drive shaft 21. We performed a printing test by changing the position of each guide.

(TEST 1)

Table 1 is the result of the transfer efficiency and printing quality in a test where paper of different thickness (ream weight) was used and the contact time of the paper 9 wound onto the photosensitive drum 1 was varied by changing the position of the guides 10 and 11. The printing test was carried out under a normal temperature and humidity condition (24° C., 50%).

TABLE 1

| Test No. | Paper thickness (μm) | Guide 10 position | Guide 11 position | Transfer area passage time (ms) | Transfer efficiency (%) | Image quality | Overall evaluation |
|---|---|---|---|---|---|---|---|
| 1 | 90 | h | a | 7 | 82 | Poor | Poor |
| 2 | 90 | h | b | 9 | 85 | Average | Average |
| 3 | 90 | h | c | 11 | 92 | Good | Excellent |
| 4 | 90 | h | d | 13 | 95 | Average | Good |
| 5 | 90 | i | a | 8 | 84 | Poor | Poor |
| 6 | 90 | i | b | 10 | 86 | Good | Average |
| 7 | 90 | i | c | 12 | 92 | Good | Excellent |
| 8 | 90 | i | d | 14 | 95 | Average | Excellent |
| 9 | 90 | j | a | 9 | 90 | Poor | Poor |
| 10 | 90 | j | b | 11 | 93 | Good | Excellent |
| 11 | 90 | j | c | 13 | 95 | Average | Average |
| 12 | 90 | j | d | 15 | 95 | Average | Average |
| 13 | 150 | h | a | 7 | 75 | Poor | Poor |
| 14 | 150 | h | b | 9 | 80 | Good | Average |
| 15 | 150 | h | c | 11 | 83 | Good | Average |
| 16 | 150 | h | d | 13 | 88 | Good | Average |
| 17 | 150 | i | a | 8 | 77 | Average | Average |
| 18 | 150 | i | b | 10 | 83 | Good | Average |
| 19 | 150 | i | c | 12 | 90 | Good | Excellent |
| 20 | 150 | i | d | 14 | 92 | Average | Good |
| 21 | 150 | j | a | 9 | 79 | Good | Poor |
| 22 | 150 | j | b | 11 | 85 | Good | Good |
| 23 | 150 | j | c | 13 | 90 | Good | Excellent |
| 24 | 150 | j | d | 15 | 93 | Average | Good |
| 25 | 200 | h | a | 7 | 71 | Average | Poor |
| 26 | 200 | h | b | 9 | 75 | Good | Poor |
| 27 | 200 | h | c | 11 | 79 | Good | Average |
| 28 | 200 | h | d | 13 | 83 | Good | Average |
| 29 | 200 | i | a | 8 | 73 | Average | Poor |
| 30 | 200 | i | b | 10 | 76 | Good | Poor |
| 31 | 200 | i | c | 12 | 82 | Good | Average |
| 32 | 200 | i | d | 14 | 88 | Good | Good |
| 33 | 200 | j | a | 9 | 73 | Average | Poor |
| 34 | 200 | j | b | 11 | 77 | Good | Average |
| 35 | 200 | j | c | 13 | 82 | Good | Average |
| 36 | 200 | j | d | 15 | 90 | Average | Good |

In the test, the printing quality was evaluated according to the degree of toner splash around a dot in the half-tone dot printing. It is understood from the results that the optimum length of the paper 9 wound onto the photosensitive drum 1 depends upon the paper thickness. For this reason, it becomes possible to maintain a favorable transfer condition for a variety of paper specifications by adjusting the length of rolled paper with the aid of the guides 10 and 11.

(TEST 2)

Using the same printing apparatus, we ran a test at different positions of the guides 10 and 11, while varying the ambient humidity to 35%, 55% and 90%, and we than evaluated the transfer efficiency and printing quality. Ordinary paper of a thickness of 150 μm was used and the corona discharge method was employed for the transfer unit. Table 2 shows the test results. The results indicate that, although a high transfer efficiency is difficult to achieve as the humidity increases, a favorable transfer condition can be maintained by adjusting the length of the paper 9 wound onto the photosensitive drum 1 with the aid of the guides 10 and 11.

TABLE 2

| Test No. | Humidity (μm) | Guide 10 position | Guide 11 position | Transfer area passage time (ms) | Transfer efficiency (%) | Image quality | Overall evaluation |
|---|---|---|---|---|---|---|---|
| 1 | 35 | h | a | 7 | 80 | Poor | Poor |
| 2 | 35 | h | b | 9 | 85 | Average | Average |
| 3 | 35 | h | c | 11 | 90 | Good | Excellent |
| 4 | 35 | h | d | 13 | 92 | Average | Good |
| 5 | 35 | i | a | 8 | 84 | Poor | Poor |
| 6 | 35 | i | b | 10 | 86 | Good | Average |
| 7 | 35 | i | c | 12 | 92 | Good | Excellent |
| 8 | 35 | i | d | 14 | 95 | Average | Excellent |
| 9 | 35 | j | a | 9 | 90 | Poor | Poor |
| 10 | 35 | j | b | 11 | 93 | Good | Excellent |
| 11 | 35 | j | c | 13 | 95 | Average | Average |
| 12 | 35 | j | d | 15 | 95 | Average | Average |
| 13 | 55 | h | a | 7 | 76 | Poor | Poor |
| 14 | 55 | h | b | 9 | 80 | Good | Average |
| 15 | 55 | h | c | 11 | 83 | Good | Average |
| 16 | 55 | h | d | 13 | 89 | Good | Average |
| 17 | 55 | i | a | 8 | 77 | Average | Average |
| 18 | 55 | i | b | 10 | 83 | Good | Average |
| 19 | 55 | i | c | 12 | 90 | Good | Excellent |
| 20 | 55 | i | d | 14 | 92 | Average | Good |
| 21 | 55 | j | a | 9 | 79 | Good | Poor |
| 22 | 55 | j | b | 11 | 85 | Good | Good |
| 23 | 55 | j | c | 13 | 90 | Good | Excellent |
| 24 | 55 | j | d | 15 | 93 | Average | Good |
| 25 | 90 | h | a | 7 | 71 | Good | Poor |
| 26 | 90 | h | b | 9 | 74 | Good | Poor |
| 27 | 90 | h | c | 11 | 79 | Excellent | Average |
| 28 | 90 | h | d | 13 | 83 | Good | Average |
| 29 | 90 | i | a | 8 | 77 | Average | Average |
| 30 | 90 | i | b | 10 | 83 | Good | Average |
| 31 | 90 | i | c | 12 | 90 | Good | Excellent |
| 32 | 90 | i | d | 14 | 92 | Good | Excellent |
| 33 | 90 | j | a | 9 | 79 | Average | Poor |
| 34 | 90 | j | b | 11 | 83 | Good | Good |
| 35 | 90 | j | c | 13 | 90 | Good | Excellent |
| 36 | 90 | j | d | 15 | 93 | Good | Excellent |

(Embodiment 2)

Figure 4:
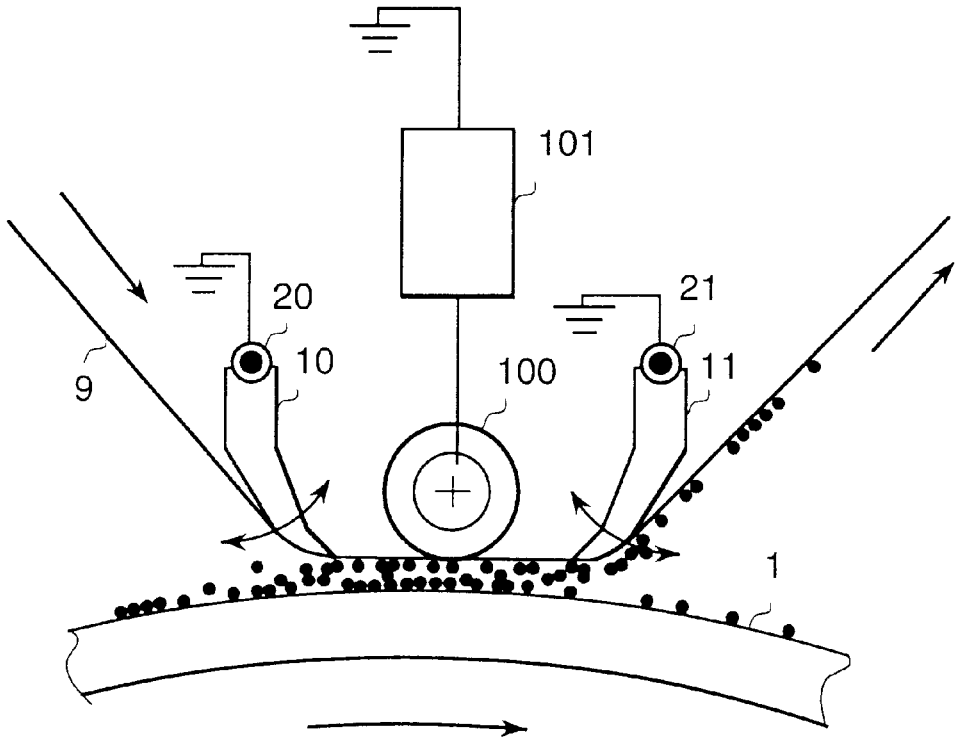
FIG. 4 is an enlarged cross-sectional view of the transfer section used in another embodiment of the present invention.

Using the transfer roller method for the transfer process, we evaluated the embodiment 2 in the same manner as in the embodiment 1. FIG. 4 is an enlarged cross-sectional view of the transfer section used in this embodiment. All printing conditions, except for the transfer process, are the same as in the embodiment 1. The transfer roller 100 is coated with PFA (perfiluoroalkoxy copolymer) to a thickness of 500 μm, and the base material of the surface-coated portion is an elastic resistive material made of conductive polyurethane rubber where resistance has been adjusted by dispersing carbon therein. The volume resistivity of the material is about $10^6$ Ωcm. FIG. 4 shows the relative positions of the photosensitive drum 1, the toner image, the paper 9 and transfer roller 100 in a typical manner. Because of this, the transfer roller 100 in FIG. 4 is shown as if it is not in contact with the surface of the photosensitive drum 1. In actuality, however, the transfer roller 100 is pressed onto the surface of the photosensitive drum 1.

The compression force of the transfer roller 100 onto the photosensitive drum 1 is set to a suitable level (normally equal to or less than 180 g/cm$^2$) that should not cause a deteriorated picture image, such as would result from an incomplete transfer. As the paper 9 is passed through the nip formed by the transfer roller 100 and photosensitive drum 1, the toner image on the photosensitive drum 1 is transferred onto the paper 9.

Besides, a transfer bias voltage is applied to the transfer roller 100 by an external power source 101 so that an electrostatic attraction effect is also added to the compression transfer process. The bias voltage is set to absolute 1,000 V or less in consideration of the dielectric strength of the photosensitive drum 1. In this embodiment, a transfer voltage of 1,300 V was applied to the transfer roller 100 and a test was performed under a normal temperature and humidity condition (24° C., 50%). The printing speed was 800 mm/sec.

The transfer efficiency and printing quality were evaluated through a similar test as that applied in the embodiment 1, where different kinds of paper were used and the contact time of the paper 9 wound onto the photosensitive drum 1 was varied by changing the position of the guides 10 and 11. Table 3 shows the results of the test. It is understood from the results that the optimum length of the paper 9 wound onto the photosensitive drum 1 depends upon the paper thickness. For this reason, it becomes possible to maintain a favorable transfer condition for a variety of types of paper having different specifications by adjusting the length of the rolled paper with the aid of the guides 10 and 11.

TABLE 3

| Test No. | Paper thickness (μm) | Guide 10 position | Guide 11 position | Transfer area passage time (ms) | Transfer efficiency (%) | Image quality | Overall evaluation |
|---|---|---|---|---|---|---|---|
| 1 | 90 | h | a | 7 | 88 | Poor | Poor |
| 2 | 90 | h | b | 9 | 88 | Average | Average |
| 3 | 90 | h | c | 11 | 92 | Good | Excellent |
| 4 | 90 | h | d | 13 | 95 | Average | Good |
| 5 | 90 | i | a | 8 | 88 | Poor | Poor |
| 6 | 90 | i | b | 10 | 90 | Good | Good |
| 7 | 90 | i | c | 12 | 92 | Good | Excellent |
| 8 | 90 | i | d | 14 | 95 | Average | Good |
| 9 | 90 | j | a | 9 | 90 | Poor | Poor |
| 10 | 90 | j | b | 11 | 91 | Good | Excellent |
| 11 | 90 | j | c | 13 | 93 | Average | Good |
| 12 | 90 | j | d | 15 | 95 | Average | Good |
| 13 | 150 | h | a | 7 | 88 | Poor | Poor |
| 14 | 150 | h | b | 9 | 90 | Average | Average |
| 15 | 150 | h | c | 11 | 93 | Good | Excellent |
| 16 | 150 | h | d | 13 | 93 | Average | Average |
| 17 | 150 | i | a | 8 | 88 | Poor | Average |
| 18 | 150 | i | b | 10 | 91 | Average | Average |
| 19 | 150 | i | c | 12 | 93 | Good | Excellent |
| 20 | 150 | i | d | 14 | 93 | Average | Good |
| 21 | 150 | j | a | 9 | 90 | Poor | Poor |
| 22 | 150 | j | b | 11 | 90 | Good | Good |
| 23 | 150 | j | c | 13 | 92 | Good | Excellent |
| 24 | 150 | j | d | 15 | 93 | Average | Good |
| 25 | 200 | h | a | 7 | 87 | Poor | Poor |
| 26 | 200 | h | b | 9 | 88 | Average | Poor |
| 27 | 200 | h | c | 11 | 90 | Good | Average |
| 28 | 200 | h | d | 13 | 92 | Good | Average |
| 29 | 200 | i | a | 8 | 88 | Poor | Poor |
| 30 | 200 | i | b | 10 | 88 | Average | Poor |
| 31 | 200 | i | c | 12 | 90 | Good | Average |
| 32 | 200 | i | d | 14 | 91 | Good | Good |
| 33 | 200 | j | a | 9 | 88 | Poor | Poor |
| 34 | 200 | j | b | 11 | 88 | Average | Average |
| 35 | 200 | j | c | 13 | 90 | Good | Average |
| 36 | 200 | j | d | 15 | 91 | Average | Good |

Where the transfer roller method is employed, a variation in the transfer performance caused by a change in the printing ambient condition, such as the humidity, tends to be less than in the corona discharge method, because the transfer current is directly supplied to the paper.

(Embodiment 3)

Figure 5:
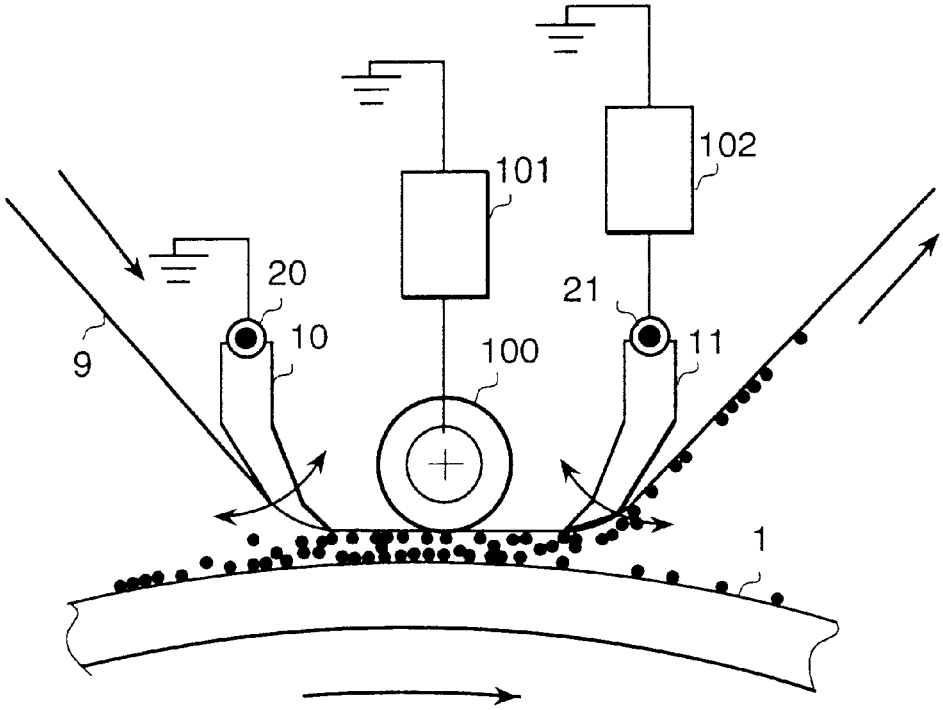
FIG. 5 is an enlarged cross-sectional view of the transfer section used in yet another embodiment of the present invention.

FIG. 5 shows an embodiment wherein an external power source 102 is connected also to the guide 11 that is installed downstream of the transfer roller 100 along the moving direction of the photosensitive body. The guide 11 is charged with electricity of reversed polarity to the charge of the toner image by the external power source 102.

Figure 6:
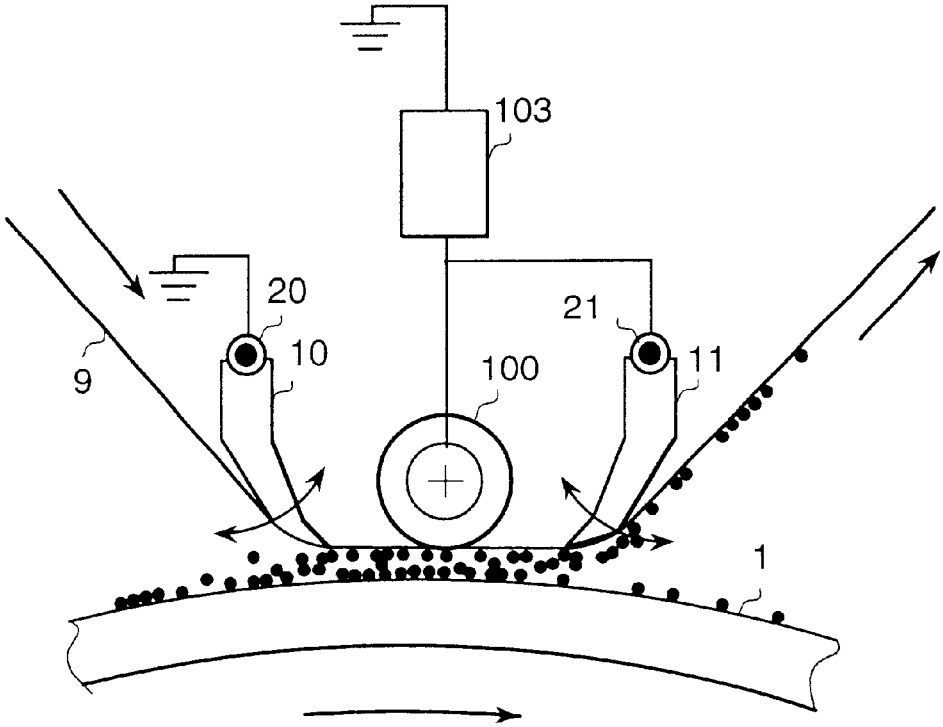
FIG. 6 is an enlarged cross-sectional view of the transfer section used in still another embodiment of the present invention.

In this embodiment, a voltage of about −800 V was applied to the guide 11 by the external power source 102. With this composition, the transfer efficiency and printing quality were evaluated in a similar manner as in the embodiment 2, where different kinds of paper were used and the contact time of the paper 9 wound onto the photosensitive drum 1 was varied by changing the position of the guides 10 and 11. It was confirmed from the results that a high-quality image can be obtained even if the transfer nip area is narrower than that in the embodiment 2 where the potential of the guide 11 was set to the ground level. Moreover, a similar effect is achieved even when a common external power source is used for the guide 11 and the transfer roller 100 as shown in FIG. 6.

The apparatus is allowed to have a composition where the guides 10 and 11 are moved and adjusted by manual operation or a composition where instruments for measuring the temperature and the humidity (not shown), and/or that for measuring the dielectric constant of the paper (not shown), are arranged near the transfer unit, and the outputs from these instruments are fed back to a microcomputer or the like so that the guides are operated and adjusted automatically, whereby the printing quality can be controlled on a real-time basis.

As described above, the present invention can provide an image forming apparatus that is capable of transferring the toner image retained on an image retaining body efficiently onto paper irrespective of changes in the ambient condition, such as temperature and humidity, and the ream weight of the paper.

What is claimed is:

1. An image forming apparatus comprising an image retaining body which is so supported as to be able to move endlessly, a transfer means which is installed at a specific distance away from the surface of the image retaining body or in contact with the surface of the image retaining body, and a paper guide means which is installed upstream and downstream, of or at least upstream or downstream the transfer means along the moving direction of the image retaining body for guiding a sheet of paper between the image retaining body and the transfer means and for pressing the paper onto the surface of the image retaining body;

said image forming apparatus being equipped with an adjusting means for adjusting the distance between the paper guide means and the transfer means along the moving direction of the image retaining body and varying the length of the paper wound onto the image retaining body, according to the ambient condition and paper specification, or at least either of the two.

2. An image forming apparatus comprising an image retaining body which is so supported as to be able to move endlessly, a transfer means which is installed at a specific distance away from the surface of the image retaining body or in contact with the surface of the image retaining body, and a paper guide means which is installed upstream and downstream, of or at least upstream or downstream the transfer means along the moving direction of the image retaining body for guiding a sheet of paper between the image retaining body and the transfer means and for pressing the paper onto the surface of the image retaining body;

said image forming apparatus being equipped with an adjusting means for adjusting the distance between the paper guide means and the transfer means along the moving direction of the image retaining body and varying the length of the paper wound onto the image retaining body, according to the ambient temperature, ambient humidity and paper thickness, or at least any one of the three.

3. An image forming apparatus comprising an image retaining body which is so supported as to be able to move endlessly, a transfer means which is installed at a specific distance away from the surface of the image retaining body or in contact with the surface of the image retaining body, and a paper guide means which is installed upstream and downstream, of or at least upstream or downstream the transfer means along the moving direction of the image retaining body for guiding a sheet of paper between the image retaining body and the transfer means and for pressing the paper onto the surface of the image retaining body;

said image forming apparatus being equipped with an adjusting means for adjusting the distance between the paper guide means and the transfer means along the moving direction of the image retaining body and varying the length of the paper wound onto the image retaining body, according to the ambient temperature, ambient humidity and dielectric constant of the paper, or at least any one of the three.

4. An image forming apparatus according to any one of claims 1 through 3, wherein a portion of said paper guide means in contact with the paper is electrically grounded.

5. An image forming apparatus according to any one of claims 1 through 3, wherein a direct current voltage of opposite polarity to the electric charge of the toner image produced on said image retaining body is supplied to said paper guide means, which is installed downstream of the transfer means along the moving direction of the image retaining body.

* * * * *